United States Patent [19]

Ripley

[11] Patent Number: 4,759,407

[45] Date of Patent: Jul. 26, 1988

[54] INVERTED WORKING BARREL AND SEAT AND METHOD OF MANUFACTURING THE SAME

[75] Inventor: Orville R. Ripley, Independence, Kans.

[73] Assignee: Mitchell Supply, Inc., Bartlesville, Okla.

[21] Appl. No.: 67,384

[22] Filed: Jun. 24, 1987

Related U.S. Application Data

[63] Continuation-in-part of Ser. No. 892,414, Aug. 4, 1986, abandoned.

[51] Int. Cl.[4] ..... F21B 43/00; F16L 09/14; F04B 47/00; B21K 1/24

[52] U.S. Cl. ..... 166/242; 166/369; 285/55; 417/453; 29/156.7 R

[58] Field of Search ..... 166/242, 369, 372, 381; 417/448, 453, 452; 285/55; 29/156.7 R, 156.7 A

[56] References Cited

U.S. PATENT DOCUMENTS

| | | | |
|---|---|---|---|
| 337,167 | 3/1886 | Laing | 417/448 |
| 940,545 | 11/1909 | McGregor | 417/448 |
| 997,076 | 7/1911 | Daniels | 285/106 |
| 1,010,098 | 11/1911 | Waitz | 285/55 |
| 1,019,507 | 3/1912 | McCormick | 285/55 |
| 1,027,665 | 5/1912 | Parker | 285/55 |
| 1,112,677 | 10/1914 | Conrader | 285/55 |
| 1,146,312 | 7/1915 | Davis | 417/448 |
| 1,309,738 | 7/1919 | Latta | 417/453 |
| 1,396,243 | 11/1921 | Beloit | 285/55 |
| 1,542,334 | 6/1925 | Burgess | 285/55 |
| 1,619,950 | 3/1927 | Marty | 417/453 |
| 1,644,998 | 10/1927 | Gunn et al. | 417/453 |
| 1,690,399 | 11/1928 | Burgess | 285/55 |
| 1,702,619 | 2/1929 | Sargent, Jr. | 417/554 |
| 1,792,941 | 2/1931 | Stevenson | 285/55 |
| 2,018,700 | 10/1935 | Blau | 166/369 |
| 2,300,648 | 11/1942 | Carlberg | 285/55 |
| 2,982,360 | 5/1961 | Morton et al. | 166/242 |
| 4,018,248 | 4/1977 | Carr | 417/553 |
| 4,308,917 | 1/1982 | Dismukes | 166/242 |
| 4,504,199 | 3/1985 | Spears | 417/456 |

*Primary Examiner*—Stephen J. Novosad
*Assistant Examiner*—Terry Lee Melius
*Attorney, Agent, or Firm*—Robert B. Stevenson

[57] ABSTRACT

A thin walled (e.g., 1/16th inch), cylindrical, stainless steel inverted working barrel and seat adapted to concentrically insert into and sleeve upwardly within the lower end of a conventional oil or gas well production string and act as a replacement for or in lieu of a conventional thick walled working barrel. The production string structurally protects the thin walled barrel allowing for a significant savings in initial or replacement costs.

2 Claims, 3 Drawing Sheets

INVERTED WORKING BARREL AND SEAT AND METHOD OF MANUFACTURING THE SAME

This is a continuation-in-part of co-pending application Ser. No. 892,414 filed on Aug. 4, 1984, now abandoned.

BACKGROUND OF THE INVENTION

1. Field of the Invention

This invention relates to an inverted working barrel and seat for downhole oil well applications and a method of manufacturing the same. More specifically, the invention relates to a thin walled, stainless steel downhole pump working barrel that concentrically slides upwards within the end of the production string and as such, serves as a low cost alternate or replacement for the original pump barrel or seating collar of the production string.

2. Description of the Prior Art

It is generally known to employ a reciprocating surface pump, such as a rocker arm, crank or other mechanical device to repeatedly lift and lower a sucker rod within a production tubing or string running from the surface to the downhole pump, wherein a plunger with traveling valve attached to the end of the sucker rod travels up and down within a polished pump barrel such as to pump fluids to the surface. Such internally polished pump barrels attached to the bottom of the production string are generally heavy walled structures that ultimately wear out, thus requiring replacement or repair. In such event, the entire production string and sucker rod are withdrawn from the well in order to service or replace the relatively expensive pump barrel.

SUMMARY OF THE INVENTION

In view of the expense associated with replacement or repair of the downhole polished pump barrel, the present invention provides a relatively inexpensive inverted working barrel and seat that can be inserted into the interior of the production string from the lower end as an alternate or replacement for the original pump barrel.

Thus, the present invention provides in an oil well production system comprising a surface reciproacting pump attached to and driving a vertical sucker rod within a production tubing consisting of a plurality of sections with threaded connectors therebetween extending from the surface to a downhole sucker rod pump wherein the downhole end of the vertically reciprocating sucker rod is attached to a pump plunger/traveling valve which reciprocates within a smooth bore containing a standing valve at the lower end of the smooth bore, the specific improvement comprising:

a thin walled, cylindrical, stainless steel tubing threadably connected to the lower end of the production tubing and concentrically inserted into and sleeved upwardly within the lower end of the production string, wherein the interior of the thin walled, cylindrical, stainless steel tubing serves as the smooth bore for the pump plunger/traveling valve and the exterior is structurally protected by the surrounding production tubing and wherein the lower interior of the thin walled, cylindrical, stainless steel tubing is further equipped with a standing valve seat retaining the standing valve and the lower exterior is adapted to threadably connect to additional equipment.

In one particularly preferred embodiment of the present invention, the thin walled, stainless steel tubing is flared or enlarged at one end such as to accommodate a cylindrical collar with an internal frustoconical surface that rests on the enlarged end. In this embodiment, an internal frustoconical fitting is compressively inserted into the interior of the enlarged end of the thin walled production tubing and compressively engaged against the tapered surface on the inside of the coupling and welded in place.

It is an object of the present invention to provide an inexpensive, yet reliable inverted working barrel for downhole oil well applications. It is a further object that this inverted working barrel be of thin walled construction and insert within the production string, thus taking advantage of the structural strength of the surrounding production string. Fulfillment of these objects and the presence and fulfillment of additional objects will be apparent upon complete reading of the specification and claims taken in conjunction with the attached drawings.

DESCRIPTION OF THE PREFERRED EMBODIMENTS

Figure 1:
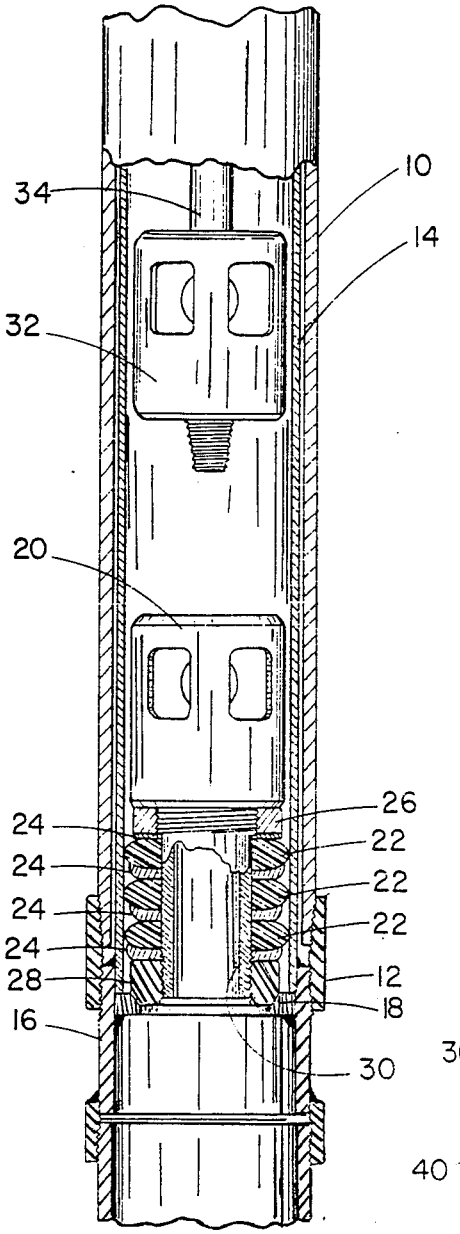
FIG. 1 is a partial cut-away side view of an inverted working barrel and seat according to the present invention and positioned at the bottom of a production string.

The improved oil production system and novel inverted working barrel with seat according to the present invention, how it differs from prior art working barrels and the advantages associated with its use can perhaps be best understood and explained by reference to the drawings. FIG. 1 illustrates the lower end of the production string or tubing 10 which is intended to be lowered down a case hole to the desired oil depth for oil production. This end of the production string (in the embodiment illustrated in FIG. 1) terminates at a threaded joint or coupling 12 which originally was connected to or intended to be connected to a relatively strong, thick walled, polished pump barrel (not shown) that would extend downward from connector 12. The interior of this thick walled pump barrel provided the original smooth surface in contact with the pump plunger. However, once the surface has worn or been corroded to such an extent that the hydraulic seal necessary to create fluid lift can no longer be sustained, the conventional and prior art remedy would be to pull the production string and replace the pump barrel section. Instead, according to the present invention, a thin walled, cylindrical stainless steel tubing 14 is inserted upwardly into the bottom of the production string 10.

As illustrated, the lower end of the thin walled, stainless steel tubing 14 is circumferentially welded to a threaded fitting 16. The upper threads on fitting 16 engage to the connector 12 at the bottom of the production tubing string 10 with the thin walled insert 14 extending concentrically upwardly within the last segment of production tubing. Within the fitting 16 is a circumferentially welded standing valve seat 18 which serves to retain the standing valve 20. It should be appreciated that as an alternative, the valve set and fitting could be cast as a single unit.

The standing valve 20 is held in place by use of seating cups 22, spacers 24 and threaded compression nuts 26 and 28. The compression nuts 26 and 28 (in this specific embodiment) thread to the outer threaded surface of tube 30 that in turn is attached to the bottom of standing valve 20 within the thin walled, stainless steel tubing 14 and rest on the standing valve seat 18 coaxially aligned with the valve seat 18. As nuts 26 and 28 tighten, seating cup rings 22 are compressed, thus expanding circumferentially inwardly and outwardly making contact and sealing with the interior of the thin walled, stainless steel tubing 14 and exterior of tube 30, thus preventing leakage around the standing valve. It should be appreciated that other methods of sealing around the standing valve, as generally known in the art, can be employed alternatively and as such, are considered equivalent for purposes of this invention.

The lower end of fitting 16 is further equipped with additional threading such as to allow for attachment of auxiliary equipment and the like. For example, downwardly projecting tubing and/or a strainer nipple or so-called mud anchor (not shown), which in principle is a perforated closed end tubing that allows for formation fluids (oil/water and the like) to flow through tubing 30 and standing valve 20 into the interior of thin walled, stainless steel tubing 14, can be attached to the lower end of fitting 16. Within the upper portion of the thin walled, stainless steel tubing 14 is a plunger/traveling valve 32 attached to the lower end of the sucker rod 34. In this case, the plunger/traveling valve 32 will be sized to fit the smooth interior of the thin walled, stainless steel tubing 14. It should be appreciated that the actual selection of the plunger/traveling valve and stationary valve employed in the present invention can be any such valve as generally known and used in the sucker rod pumping art. As such, the basic difference between the present invention and the prior art devices is found in the use of the inverted, thin walled, insert tubing 14 as the pump barrel. This novel feature in turn leads to the practical advantage of significant cost savings that further distinguishes the present invention from the prior art devices, even though the mode of operation of the pump once installed is identical or at least equivalent to what is presently practiced in the oil field.

Figure 2:
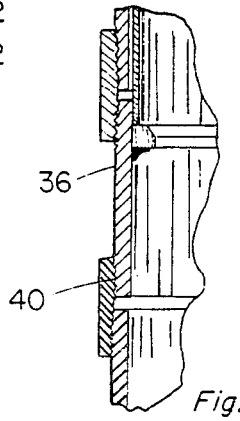
FIG. 2 is a partial cut-away side view of an alternate embodiment of the inverted working barrel and seat according to the present invention.

FIG. 2 illustrates another specific embodiment of the present invention. In this specific embodiment, the fitting 36 with standing valve (not shown) is externally threaded at the lower end 38 such as to act as a coupling similar to the production string connectors. In all other respects, this embodiment functions equivalently to the embodiment of FIG. 1.

Figure 3:
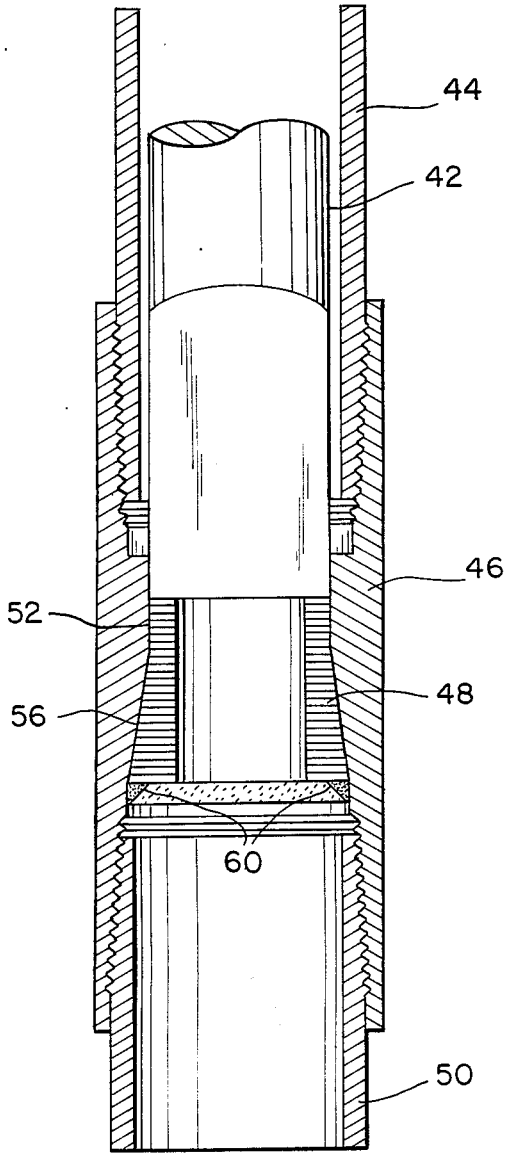
FIG. 3 is a partial cut-away side view of still another alternate embodiment of the inverted working barrel and seat according to the present invention.
Figure 4:
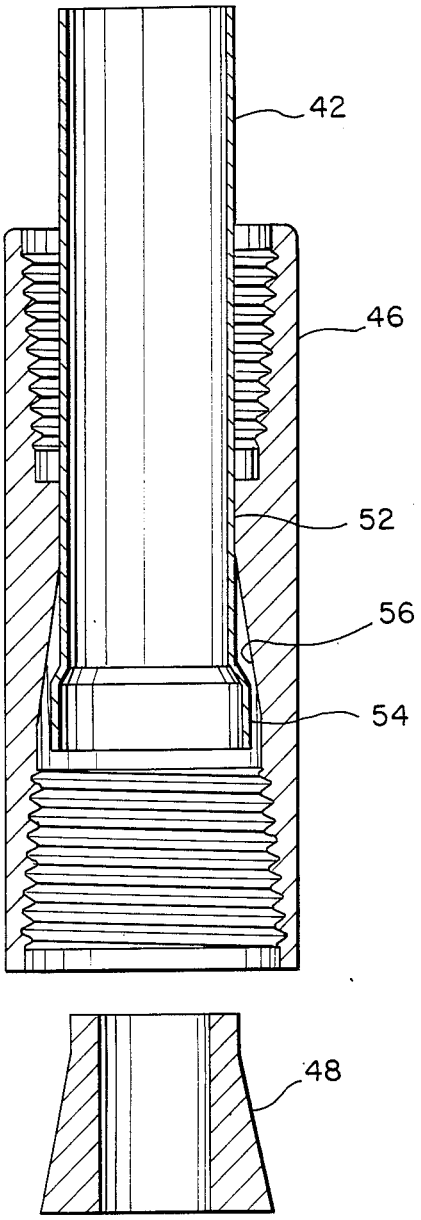
FIG. 4 is a cross-sectional view of the thin walled working barrel of FIG. 3 prior to final assembly.

FIGS. 3 and 4 illustrate another particularly preferred embodiment of the present invention wherein the inverted thin walled working barrel 42 is inserted upwardly into the production tubing 44 and threadably held in the presence of a specially designed collar 46 and internal compressive fitting 48. Similar to the previous embodiments, the lower end of the collar 46 is also threaded such as to hold a mud anchor 50 or the like. As illustrated in FIG. 4, the thin walled working barrel 42 sleeves into the collar 46 essentially making contact with the top portion of the guide section 52. The lower end of the thin walled tubing 42 is expanded in diameter such as to produce an off-set 54 that engages to the frustoconical tapered surface 56 found on the lower portion of the guide section 52. A frustoconical compression fitting 48 is then compressively inserted into the interior of the expanded end 54 of the thin walled tubing 44 and welded 60 in place (see FIG. 3), thus completing the assembly. As shown, the compression fitting 48 has an opening therethrough for oil and gas production while the upper edge serves as the seat for the stationary valve (not shown).

The inverted working barrel and seat according to the present invention is envisioned as being useful in virtually all oil well applications that historically have been amenable to conventional sucker rod downhole pump applications (e.g., at depths from a few hundred feet to as great as about 3,000 feet or even more). Because the thin walled insert is retained entirely within the structurally rigid production tubing, the lack of structural strength is not detrimental in that any external impact or pressure gradient is already accounted for in the existing equipment within the well. Thus, for purposes of this invention, the term "thin walled, stainless steel tubing" is explicitly describing a tubing within a sidewall dimension on the order of 1/16th of an inch.

The advantages and benefits of employing the inverted working barrel according to the present invention are considered significant. The inherent economy of employing a thin walled tube as opposed to a polished pump barrel of the prior art represents a significant savings. Furthermore, the inverted working barrel is installed on the production tubing in a manner equivalent to previously known processes without necessitating any additional downtime, except the working barrel inserts into rather than extends from the end of the production string. Furthermore, it is envisioned that the inverted working barrel will have substantially the same production capacity as standard equipment. Thus, the overall improved oil production system of the present invention is simple in construction, highly reliable and relatively inexpensive, yet functions in a manner and at a rate essentially identical to the original or standard downhole sucker rod pump system.

Having thus described the invention with a certain degree of particularity, it is manifest that many changes can be made in the details of construction and the arrangement of components without departing from the spirit and scope of this disclosure. Therefore, it is to be understood that the invention is not limited to the embodiments set forth herein for the purposes of exemplification, but is to be limited only by the scope of the attached claims, including a full range of equivalents to which each element thereof is entitled.

I claim:

1. An inverted working barrel comprising:

(a) a thin walled, cylindrical, stainless steel tubing adapted to sleeve upwardly within the lower end of a production string, wherein the interior of the thin walled, cylindrical, stainless steel tubing serves as the smooth bore for the pump plunger and traveling valve and wherein the lower end of said thin walled, cylindrical, stainless steel tubing is further characterized by the presence of a displacement to a slightly larger diameter producing a slight off-set at the lower end;

(b) a cylindrical collar sleeved onto said thin walled, cylindrical, stainless steel tubing and resting on said slightly larger diameter off-set lower end wherein said cylindrical collar is further characterized with internal threading at each end adapted to connect to the production string at the top end and to a mud anchor at the bottom end and wherein said cylindrical collar is further characterized by an internal guide section between the internal threaded ends, wherein the top portion of said guide section is a cylindrical opening essentially the same size as the outer diameter of said thin walled, cylindrical, stainless steel tubing and wherein the bottom portion of said guide section is a frustoconical surface tapering from the outer diameter of said thin walled, cylindrical, stainless steel tubing to the dimensions of the internal threaded end, such that said tapered surface rests on said off-set of said slightly larger diameter end at the lower end of said thin walled tubing; and (c) a frustoconical tapered plug with an axial opening therethrough compressively engaged to the interior of the slightly larger diameter of the lower end of said thin walled tube within said cylindrical collar producing a compressive fitting with said frustoconical surface of said guide section and attached to said cylindrical collar in compressive engagement therewith.

2. A method of manufacturing an inverted working barrel comprising the steps of:

(a) providing a thin walled, cylindrical, stainless steel tubing adapted to sleeve upwardly within the lower end of a production sting, wherein the interior of the thin walled, cylindrical, stainless steel tubing serves as the smooth bore for the pump plunger and traveling valve and wherein the lower end of said thin walled, cylindrical, stainless steel tubing is further characterized by the presence of a displacement to a slightly large diameter producing a slight off-set at the lower end;

(b) providing a cylindrical collar sleeved onto said thin walled, cylindrical, stainless steel tubing and resting on said slightly larger diameter off-set lower end wherein said cylindrical collar is further characterized with internal threading at each end adapted to connect to the production string at the top end and to a mud anchor at the bottom end and wherein said cylindrical collar is further characterized by an internal guide section between the internal threaded ends, wherein the top portion of said guide section is a cylindrical opening essentially the same size as the outer diameter of said thin walled, cylindrical, stainless steel tubing and wherein the bottom portion of said guide section is a frustoconical surface tapering from the outer diameter of said thin walled, cylindrical, stainless steel tubing to the dimensions of the internal threaded end, such that said tapered surface rests on said off-set of said slightly larger diameter end at the lower end of said thin walled tubing;

(c) inserting the thin walled, cylindrical, stainless steel tubing within said cylindrical collar such that said off-set makes compressive engagement with said frustoconical surface;

(d) providing a frustoconical tapered plug with an axial opening therethrough adapted to compressively engage to the interior of the slightly larger diameter of the lower end of said thin walled tube within the cylindrical collar producing a compressive fitting with said frustoconical surface of said guide section and attached to said cylindrical collar in compressive engagement therewith;

(e) compressively inserting said frustoconical tapered plug with axial opening therethrough into the interior of the slightly larger diameter lower end of said thin walled tube within said cylindrical collar producing a compressive engagement with said frustoconical surface of said guide section; and (f) premanently attaching said frustoconical tapered plug to said cylindrical collar.

* * * * *